United States Patent [19]

Nakano et al.

[11] 4,100,909

[45] Jul. 18, 1978

[54] LUBRICATION SYSTEM FOR AIR-COOLED ENGINES

[75] Inventors: Keiichi Nakano; Kouji Nakai, both of Sakaishi, Japan

[73] Assignee: Kubota, Ltd., Osaka, Japan

[21] Appl. No.: 790,974

[22] Filed: Apr. 26, 1977

[30] Foreign Application Priority Data

Jan. 24, 1977 [JP] Japan ..... 52/7140

[51] Int. Cl.[2] ..... F01M 1/00

[52] U.S. Cl. ..... 123/196 AB; 123/90.38; 123/41.33

[58] Field of Search ..... 123/196 AB, 90.37, 90.38, 123/41.33, 41.69, 90.55; 184/6.5, 6.9

[56] References Cited

U.S. PATENT DOCUMENTS

| | | | |
|---|---|---|---|
| 1,655,518 | 1/1928 | Smith | 123/41.33 |
| 1,721,341 | 7/1929 | Halford | 123/90.38 |
| 2,012,739 | 8/1935 | Brown | 123/41.69 |
| 2,366,701 | 1/1945 | Doman | 123/90.55 |
| 2,902,022 | 9/1959 | Bakke et al. | 123/90.38 |

*Primary Examiner*—Ronald H. Lazarus
*Attorney, Agent, or Firm*—Bacon & Thomas

[57] ABSTRACT

A V-shaped, air-cooled engine has a lubricant pump located in the lower portion of the crankcase, and at least partly immersed in the engine lubricating oil so that oil is contained therein at all times. Lubricating oil is pumped to the cylinders through internal passages in the crankcase, and through annular passages between the valve push rods and their tubular housings. Lubricant return passages lead through the cooling fins provided on the cylinders, so that cooling air flowing over the cylinder fins serves to cool the lubricating oil.

7 Claims, 6 Drawing Figures

LUBRICATION SYSTEM FOR AIR-COOLED ENGINES

BACKGROUND OF THE INVENTION

1. Field of the Invention

The present invention relates generally to lubrication systems for use in air-cooled, overhead cam internal combustion engines. More particularly, it relates to an improved lubrication system for such an engine, wherein the presence of lubricating oil within the pump is assured at all times, and the returning lubricating oil is cooled by the flow of cooling air over the engine.

2. Description of the Prior Art

Air-cooled, internal combustion engines equipped with overhead cams are known. In the conventional engine of this type, a lubricant pump is located above the level of the lubricating oil stored in the engine crankcase. As a result, when the engine is initially operated after its manufacturing or its repairing, only air is pumped through the lubrication system. This occurs because time is required to draw lubricating oil from the reservoir into the pump. The result of this arrangement is that detrimental friction occurs between the components, which can cause premature excessive wear, or even seizures. In order to avoid this problem, a common practice is to previously apply lubricant to the pump by hand. However, this method involves considerable labor, and may not be totally effective. Further, the circulation of the lubricating oil may fall behind, resulting in damage to the engine.

The conventional engine of this type also requires special oil conduits leading to and from the cylinder head region, which add expense to the engine construction. Further, cooling of the lubricating oil is sometimes less than adequate, because of the location of return passages.

There is need for an improved lubrication system for air-cooled, overhead cam engines, designed to overcome these problems with conventional lubrication systems for such engines. The present invention is intended to satisfy that need.

SUMMARY OF THE INVENTION

In the engine lubrication system of the present invention the lubricant pump is located below the crankshaft within the engine crankcase, in a position where it is at least partially immersed in the pool of lubricating oil contained in the bottom of the crankcase. Because of this positioning, the pump normally contains lubricating oil, through the simple force of gravity. The result is that the lubricant pump contains lubricating oil from its initial operation, and oil is quickly supplied to the moving elements of the engine immediately upon engine start-up.

In the invention the crankcase is provided with internal passages leading from the lubricant pump to where the cylinders protrude from the crankcase. However, instead of transmitting the lubricating oil from these internal crankcase passages to the head chambers of the cylinders by the usual separate conduits, the oil is passed through an annular supply passage provided between the push rods utilized to operate the valves of the cylinders, and cylindrical housings in which the push rods are enclosed. This assures maximum lubrication of the push rods, and simplifies the design and appearance of the engine.

In order to effect proper cooling of the lubricating oil, return passages are provided from the head chambers of the cylinders to the crankcase, and pass through the cooling fins of the cylinders. Thus, the cooling air flowing over the finned cylinders acts to cool the lubricating oil, preventing breakdown thereof from overheating.

It is a principal object of the present invention to provide a lubrication system for an air-cooled, overhead cam engine wherein the presence of lubricating oil in the lubricant pump is assured from the initial operating of the pump.

A further object is to provide a lubrication system for such an engine which eliminates the need for separate conduits leading to the cylinder heads, and which assures adequate lubrication of the engine valves and their operating mechanism.

Another object of the invention is to provide an engine lubrication system designed to assure that the lubricating oil is adequately cooled by the flow of cooling air over the engine during operation thereof.

Other objects and many of the attendant advantages of the present invention will become readily apparent from the following Description of the Preferred Embodiment, when taken in conjunction with the accompanying drawings.

DESCRIPTION OF THE PREFERRED EMBODIMENT

Figure 1:
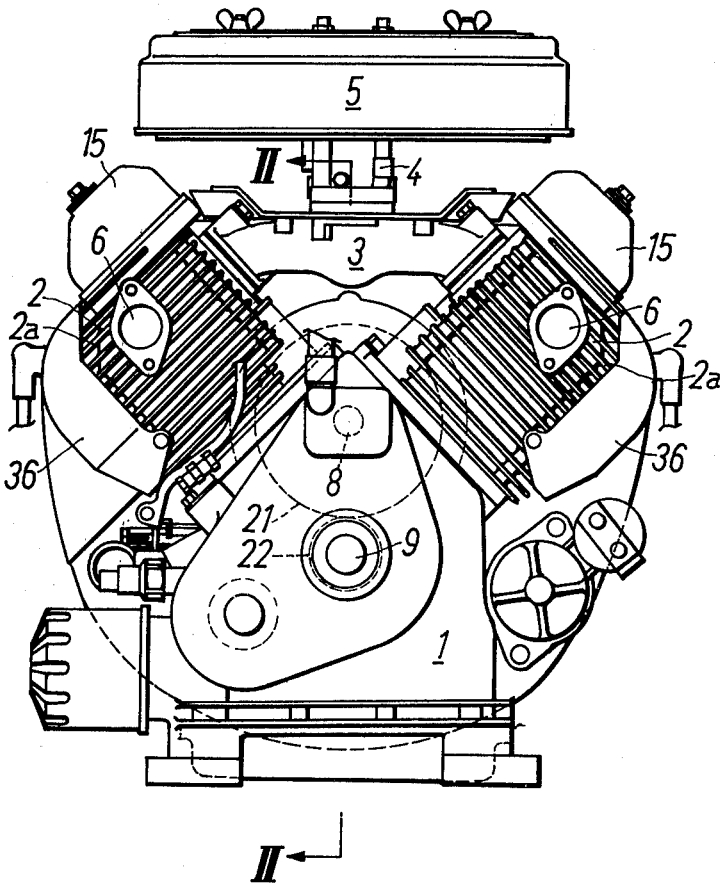
FIG. 1 is a rear elevational view of an air-cooled, overhead cam engine constructed according to the invention, with the muffler and the conduits connecting it to the cylinder exhaust ports removed.

Referring now to the drawing, the V-shaped, overhead cam air-cooled engine of the invention includes a crankcase 1 having projecting cylinders 2 mounted thereon, so as to form a letter V, the cylinders carrying cooling fins 2*a*, and being connected by an inlet pipe 3 mounted to extend therebetween. A down-draft type carburetor 4 is mounted on the inlet pipe 3 centrally thereof, and carries a disc-shaped air cleaner 5 which includes a ring-shaped filter made of paper. The cylinders 2 are provided with exhaust ports 6 on the rear side thereof, which are connected with a muffler (not shown) by exhaust pipes (not shown).

The crankcase 1 contains a crank chamber 7, within which are mounted a crankshaft 9 and a valve-driving camshaft 8. The camshaft 8 lies directly above the crankshaft 9 in the same vertical plane, which plane also includes the longitudinal axis of the engine. A drive gear 22 is mounted on the crankshaft 9 and engages a gear 21 carried by the camshaft 8, the gears 21 and 22 being received within a cavity formed in the front of the crankcase 1 and which is covered by a removable cover 24. The front end of the crankshaft 9 projects through the cover 24, and carries a flywheel cooling fan 32 thereon.

The cooling fan 32 is enclosed by a cover 33, provided with a screened air inlet 34 centrally thereof. Air outlet openings 35 are provided at the rear of the cover 33 on each side of the engine, and lead to elongated enclosures 36 that direct cooling air over the fins 2*a* on the cylinders 2 to effect cooling thereof. Cooling air is thus drawn in through the inlet 34 by the flywheel cooling fan 32, passed through the outlet openings 35, and is directed against the cooling fins 2*a* and the cylinders 2 by the elongated side enclosures 36, from whence it passes rearwardly over the engine.

Figure 6:
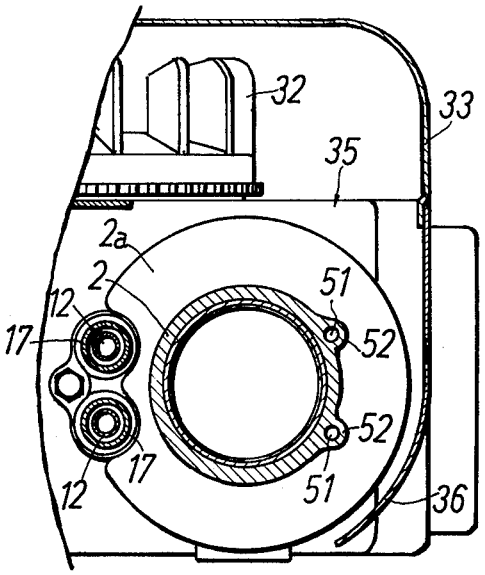
FIG. 6 is an enlarged sectional view taken along the line VI—VI in FIG. 4, showing the push rods and their associated housings, and the return passages and their relationship to the cooling fins.
Figure 5:
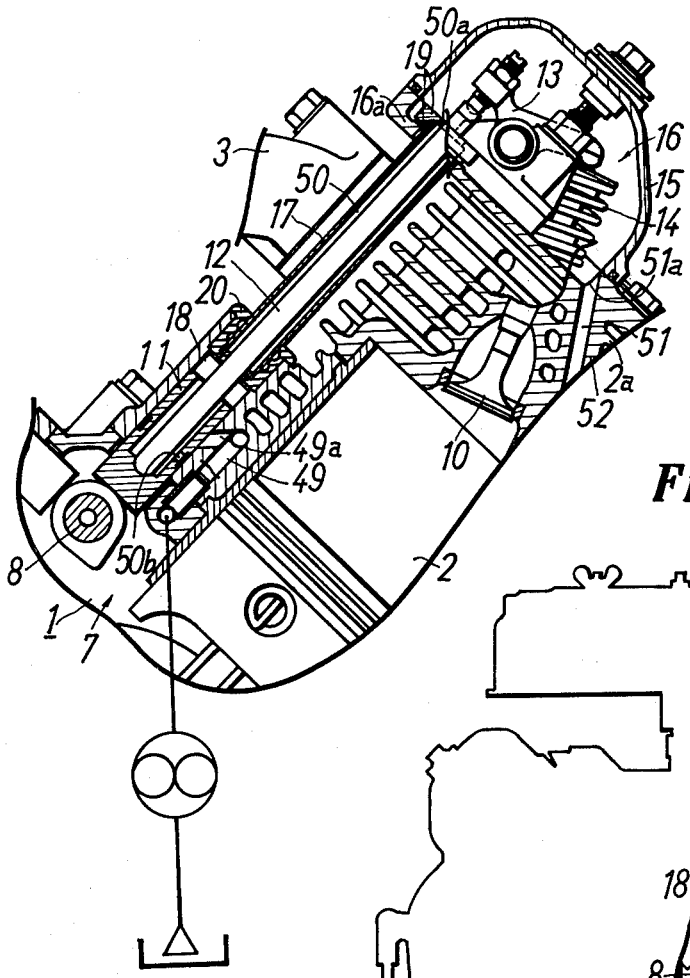
FIG. 5 is an enlarged cross-sectional view similar to FIG. 4, and showing the details of one of the push rods for operating the valves, and its associated housing.
Figure 4:
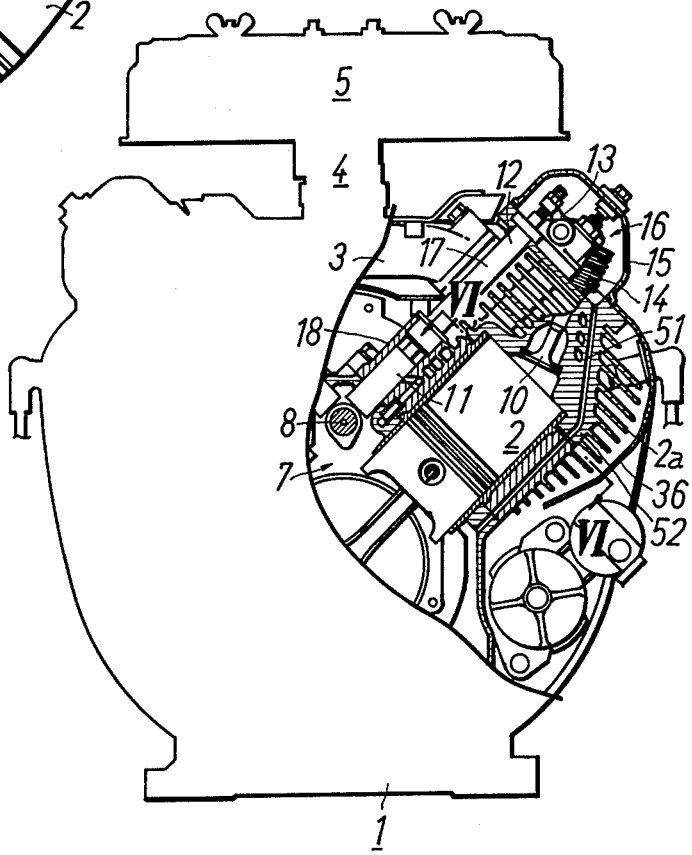
FIG. 4 is a fragmentary, vertical cross-sectional view through one of the cylinders of the engine of FIG. 1.

Referring now in particular to FIGS. 4–6, each cylinder 2 has an enclosed head chamber 16 thereon, formed by a flange 16*a* on the outer end of the cylinder which contains a slanted bottom recess, and a removable valve arm cover 15. The cylinders 2 have inlet-exhaust ports which are fitted with valve cores 10, each valve core 10 projecting above the slanted bottom wall of the recess on the cylinder head and carrying a spring 14 which biases it toward a normally seated position. Valve operating arms 13 are pivotally mounted within the head chambers 16, and one end of each arm engages and operates the associated valve core 10. The other ends of the valve operating arms 13 are connected to the upper ends of push rods 12, two of which are provided for each cylinder, as shown in FIG. 6.

The push rods 12 are enclosed by cylindrical push rod housings 17, the upper ends of which are secured by fasteners 19 within openings provided in the flanges 16*a*, and the lower ends of which are secured by fasteners 20 within the upper ends of push rod bosses 18 mounted on the crankcase 1. Tappets 11 are slidably mounted within the through axial bores of the push rod bosses 18, the lower ends thereof being engaged with the camshaft 8, and the upper end of each containing an elongated, enlarged diameter socket which receives the lower end of the associated push rod.

The cylindrical push rod housings 17 not only enclose the push rods 12, but also form oil passages leading from the crankcase 1 to the enclosed head chambers 16. For this purpose, the internal diameters of the housings 17 are substantially larger than the external diameters of the push rods 12, so that annular supply passages 50 are formed therebetween, the upper ends 50*a* of the annular supply passages thus formed opening into the slanted recesses in the flanges 16*a* at the upper ends of the cylinders 2. The sockets in the tappets 11 are also of larger diameter than the push rods 12, to form corresponding annular passages leading to the supply passages 50 formed by the push rod housings 17.

The sidewall defining the socket of each tappet 11 has a port 50*b* formed therein, placed within an annular groove on the tappet. The push rod bosses 18 have ports 49*a* therein are alignable with the annular grooves of the ports 50*b* when the tappets 11 are moved upwardly by the camshaft 8, whereupon a passage for admitting lubricating oil to the cylinder head chamber 16 is then opened. This passage is closed again when the respective tappet 11 is returned to its downward position. The repeated opening and closing of the ports 50*b* and the reciprocal motions of the tappets 11 cause lubricating oil admitted to the annular passage 50 extending through the push rod housing 17 to be pumped into the associated head chamber 16, where it lubricates the moving elements mounted on the cylinder head. The push rods 12 and the tappets 11, and other associated components, are of course also lubricated by this flow of lubricating oil.

Figure 2:
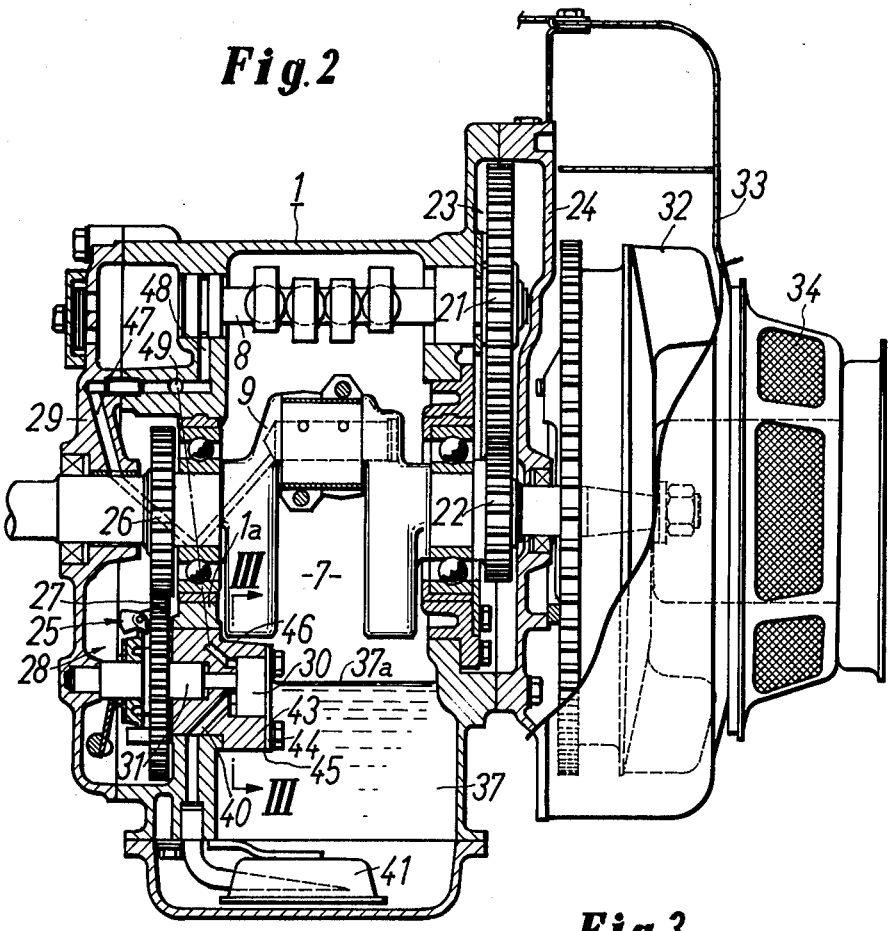
FIG. 2 is a vertical sectional view taken through the engine of FIG. 1, taken along the line II—II in FIG. 1, and showing the arrangement of the lubricant pump, the crankshaft, the camshaft, and other engine components.
Figure 3:
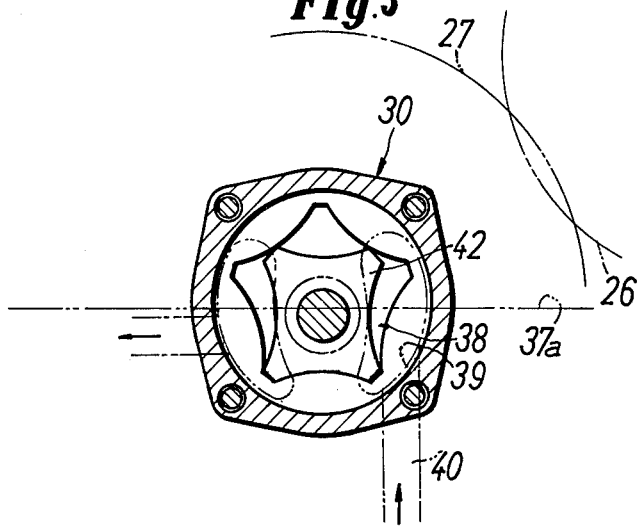
FIG. 3 is an enlarged, fragmentary cross-sectional view through the lubricating pump, taken along the line III—III of FIG. 2, with certain flow passages and ports shown in phantom lines, for purposes of clarity.

Turning now to FIG. 2, a governor 25 is mounted at the rear of the crankcase 1 within a governor chamber 28 covered by a cover 29 secured to the back wall 1*a* of the crankcase 1. The governor 25 includes a governor shaft 31, operated from the crankshaft 9 by gears 26 and 27. The shaft 31 is vertically beneath the crankshaft 9, and also operates a rotary pump 30 connected thereto.

The rotary pump 30 is attached to the back wall 1*a* of the crankcase 1, and includes a pump casing 43 containing a chamber 38 within which a rotor 42 is received, the casing 43 being closed by a lid 44 which forms a joint 45 with the casing. The pump 30 is located so that it is at least partly immersed in the lubricating oil 37 stored in the lower portion of the chamber 7, with at least a portion of the chamber 38 being disposed beneath the surface 37*a* of the oil. A suction port 39 opens to the rotor 42, and is connected with a passage 40 in the pump casing 43, which in turn is connected to a conduit leading to an intake strainer 41 placed on the bottom of the chamber 7. With this arrangement, gravity forces lubricating oil 37 through the inlet 41 and the passage 40, into the chamber 38. This ensures that the rotor 42 will have a supply of lubricating oil present at all times, and avoids the problem of pumping air that now occurs in conventional engine arrangements. Further, by having the joint 45 immersed in the lubricating oil 37, any oil leak will be of no consequence and will not result in the loss of oil.

The lubricating oil 37 is distributed by the lubricant pump 30 to the moving components of the engine, through passages 46 and 49, the passages 49 leading to the cylinders 2 being connected with the ports 49*a* described earlier. Thus, lubricating oil 37 is supplied to the port 50*a*, and flows downwardly over the operating arms 13 and associated elements. The lubricating oil is then collected in the slanted recess provided at the cylinder head, and flows into drain ports 51*a* leading to return passages 51 that are contained within longitudinal projections 52 carried by the fins 2*a* at the base thereof.

The projections 52 are formed on the periphery of the cylinders 2 in the upstream and downstream sections of cooling air, as such air passes over the cylinders 2 and their fins 2*a*. Thus, heated oil passing through the return passages 51 to the chamber 7 is cooled by the flowing air, and at the same time the usual separate return conduits are eliminated. Cooling of the returning oil avoids possible degradation thereof because of overheating, and thus reduces the frequencies of changing oil.

The arrangement of the slanted bottom recess at the top of each cylinder, in cooperation with inlet ports 50*a*at the top of the slanted surface and drain ports 51*a* at the bottom, ensures that the lubricating oil 37 will be well sprinkled in the head chamber 16, with such being forced into the chamber 16 by the action of the tappets 11 and their associated push rods 12. The return passages 51 are sized to assure proper flow of oil from the head chambers 16 back to the crankcase chamber 7, so that a relatively constant amount of lubricating oil is maintained in the chambers 16.

The use of the push rod housings 17 for the supply passages 50 eliminates the usual separate conduits, and in addition assures proper lubrication of the tappets 11 and the push rods 12. Further, the arrangement utilizes the movements of the tappets 11 and the push rods 12 to pump the lubricating oil into the chambers 37. The result is a supply arrangement that is simpler than in past engines, and which provides effective lubrication.

Similarly, the elimination of the separate return or drain conduits from the head chamber 16, accomplished by use of the drain passages 51 in the projections 52, simplifies engine construction. At the same time, cooling of the returning oil is accomplished.

Obviously, many modifications and variations of the invention are possible.

What is claimed is:

1. In an air-cooled engine having an air-cooled lubrication system, the combination of:

a crankcase having a chamber therein, the lower portion of said crankcase chamber being a reservoir for containing lubricating oil;

at least one cylinder mounted on said crankcase to project therefrom, said cylinder having cooling fins thereon and being provided with a head chamber at its head end;

valve means associated with said cylinder, and including valve operating arm means housed within said head chamber;

push rod means associated with said valve operating arm means, and including at least one push rod extending between said head chamber and said crankcase;

housing means enclosing said push rod, and forming an annular supply passage thereabout;

a lubricant pump mounted within said crankcase chamber and arranged to be at least partially immersed in lubricating oil contained in said reservoir portion of said chamber, whereby the operating chamber of said pump is assured to contain lubricating oil before start-up;

passage means connecting said lubricant pump with said annular supply passage, to supply lubricating oil to said head chamber; and return passage means leading from said head chamber to said crankcase chamber, said return passage means extending through said cooling fins whereby air flowing over said fins is effective to cool the returning lubricating oil.

2. In an air-cooled engine as recited in claim 1, including additionally:

a push rod boss mounted on said crankcase, said boss having an axial bore therethrough, the lower end of said housing means being connected with the upper end of said boss, and the lower end of said push rod means being received in the upper end of said axial bore;

a tappet slidingly received in the lower end of said axial bore, and having an enlarged diameter socket in the upper end thereof for receiving the lower end of said push rod means;

an inlet port formed in the sidewall portion of said tappet defining said socket; and a supply port in said boss spaced from said inlet port when said tappet is positioned at its downward position, and alignable with said inlet port as said tappet moves upwardly within said axial bore to operate said push rod means, said enlarged diameter socket being in communication with said annular supply passage, and said supply port being connected with said lubricant pump.

3. In an air-cooled engine as recited in claim 1, wherein the head of said cylinder has a recess formed thereon with a slanted bottom wall, said annular supply passage opening onto the upper portion of said slanted bottom wall, and said return passage means including a drain port located at the lower end of said slanted bottom wall.

4. In an air-cooled engine as recited in claim 1, wherein said lubricant pump is a rotary pump and includes a rotor, said pump being mounted so that said rotor is normally immersed at least partially in lubricating oil contained within said reservoir portion of said crankcase chamber.

5. In an air-cooled engine as recited in claim 1, wherein said return passage means is contained within a protuberance formed on the exterior of said cylinder to extend axially thereof, and which connects with said cooling fins.

6. In an air-cooled engine as recited in claim 1, wherein said combination includes a pair of cylinders arranged in a V-shape on said crankcase, each of said cylinders having cooling fins thereon.

7. In an air-cooled engine as recited in claim 6, including additionally:

cooling fan means mounted on said crankcase for generating a flow of cooling air; and cover means secured to said crankcase, and arranged to direct cooling air from said fan means over said finned cylinders, to cool said cylinders and lubricating oil flowing through said return passage means.

* * * * *